United States Patent [19]

Grand

[11] 3,950,276

[45] Apr. 13, 1976

[54] SULFONATE DETERGENT COMPOSITIONS

[75] Inventor: Paul Sheldon Grand, South Bound Brook, N.J.

[73] Assignee: Colgate-Palmolive Company, New York, N.Y.

[22] Filed: May 22, 1972

[21] Appl. No.: 255,357

Related U.S. Application Data

[63] Continuation-in-part of Ser. No. 198,455, Nov. 12, 1971, abandoned.

[52] U.S. Cl. ..... 252/536; 252/535; 252/DIG. 15

[51] Int. Cl.[2] ..... C11D 1/37; C11D 3/08

[58] Field of Search ..... 252/535, 536, 539, 540, 252/554, 555

[56] References Cited

UNITED STATES PATENTS

| | | | |
|---|---|---|---|
| 2,954,348 | 9/1960 | Schwoeppe | 252/109 |
| 3,272,753 | 9/1966 | Wixon | 252/529 |
| 3,519,054 | 7/1970 | Cavataio et al. | 159/48 |
| 3,590,001 | 6/1971 | Taylor et al. | 252/526 |
| 3,600,318 | 8/1971 | Mast | 252/89 |
| 3,609,090 | 9/1971 | Sundby et al. | 252/8.7 X |
| 3,654,168 | 4/1972 | Gaiser | 252/135 |
| 3,658,727 | 4/1972 | Mast | 252/538 |

FOREIGN PATENTS OR APPLICATIONS

| | | |
|---|---|---|
| 586,622 | 11/1959 | Canada |
| 688,754 | 3/1953 | United Kingdom |
| 939,878 | 10/1963 | United Kingdom |

OTHER PUBLICATIONS

Kastra, R. D., "Formulating Detergents with Less Phosphate," Soap & Chemical Specialties, Feb. 1971, pp. 36, 38, 40, 42, 54, 56 & 107.

Schneider, G., "Detergent Materials from Petrochemicals," Soap & Chemical Specialities, Nov. 1970, pp. 56, 58, 60, 62 and 64.

Sosis, Def. Pub., Search Copy of Serial No. 110,344, filed Jan. 1, 1971, Def. Pub. No. T896,025.

McCutcheon, *Synthetic Detergents*, MacNair–Dorland Co., N.Y., 1950, pp. 250, 282.

Merrill et al., "Alky Aryl Sulfonates–Builder Mixtures," Industrial & Engineering Chemistry, May 1950, Vol. 42, No. 5, pp. 856–861.

Vaughn et al., "The Effect of CMC on Synthetic Detergent Systems," JAOCS, Feb. 1948, pp. 44–51.

Warren, "Soluble Silicates as Detergent Builders," Soap and Chem. Specialties," pp. 50–53, 63.

Maloney, "Detergent Phosphorus Effect on Algae," Journal of Water Pollution Control Federation," Vol. 38, No. 1, pp. 38–45.

*Primary Examiner*—P. E. Willis, Jr.
*Attorney, Agent, or Firm*—Herbert S. Sylvester; Murray M. Grill

[57] ABSTRACT

An essentially phosphate-free high performance laundry detergent composition containing olefin sulfonate detergent, sodium silicate and nonionic detergent in particular ratios.

6 Claims, No Drawings

SULFONATE DETERGENT COMPOSITIONS

This application is a continuation-in-part of copending application Ser. No. 198,455 filed Nov. 12, 1971, now abandoned entitled "Sulfonate Detergent Compositions" of Paul Grand, the disclosure of which is incorporated herein by reference.

Conventional high performance laundry detergent compositions for household use (e.g. for automatic clothes-washing machines) contains relatively large amounts of phosphates. For instance, one high performance composition contains about 33% pentasodium tripolyphosphate, together with about 10% of sodium linear alkylbenzene ("LAS"), 2% soap, 2% nonionic detergent, 0.5% carboxymethylcellulose, and 7.5% sodium silicate. In view of the widespread opinions that the use of phosphates may be ecologically undesirable, there have been introduced a great many LAS-containing detergent compositions that are substantially free of phosphates. These, however, do not have the high cleaning power of the phosphate compositions mentioned above, and often present other problems such as health hazards, damage to automatic washing machines and undesirable feel of the washed fabrics. The phosphate-free or low phosphate compositions which have recently been marketed include the compositions, A through T, whose percentage compositions are tabulated in the accompanying Table I.

A recent article in Soap & Chemical Specialties June, 1971 by Louis McDonald states, with respect to alkali silicates in detergents:

"Their primary drawbacks are that they must be used at relatively high levels of pH, — 11.6 or higher, and that they must be used in soft water. Otherwise, they combine with the calcium and magnesium of hard water and deposit a residue or scum on the material being cleaned. In laundering the alkali silicates have long been used with success in soft water, at high temperatures (180°F) at high levels of pH, with fatty acid soaps."

In accordance with one aspect of this invention there has now been developed an essentially phosphate free laundry detergent composition which has a cleaning power equal or greater than the aforesaid high performance high phosphate detergent. This new composition has been found to be highly effective against a wide variety of soils, including clay and carbon soils, skin soil, natural and artificial sebum soils, particulate soils, etc., as well as in clean load yellowing tests, for a wide variety of fabrics, including cotton, nylon, polyester (e.g. polyethylene terephthalate), etc. Thus, unlike the essentially phosphate free compositions of the prior art, it provides a true replacement for the high performance high phosphate detergents. This has also been demonstrated in repeated tests with ordinary household laundry bundles.

TABLE I

| | A | B | C | D | E | F | G | H | I | J |
|---|---|---|---|---|---|---|---|---|---|---|
| LAS (%) | — | 3.7 | — | 17.4 | 16.4 | 15.7 | 2.3 | 8.1 | 2.3 | 16.5 |
| Nonionic detergent (%) | 12.8 | 1.4 | 6.0 | — | — | — | 8.3 | — | 6.3 | — |
| Sodium carbonate (%) | 66.5 | 16.3 | 20.7 | 20.1 | 27.1 | 31.5 | 62.0 | 71.2 | 55.8 | 29.8 |
| Sodium sulfate (%) | 1.2 | 8.9 | 35.9 | 35.9 | 32.3 | 30.2 | 3.0 | — | — | 28.1 |
| Sodium silicate (%) | 8.6 | 38.6 | 7.1 | 12.5 | 12.1 | 13.2 | 9.8 | 7.2 | 18.7 | 13.2 |
| NTA (%) | — | — | — | — | — | 5.2 | — | — | — | — |
| Sodium carboxymethyl cellulose (%) | 2.4 | 2.5 | 2.1 | 4.2 | 5.0 | Present | 1.1 | 0.6 | 0.2 | 3.1 |
| Borax (%) | — | — | 15.9 | 0.5 | 1.0 | — | — | — | — | — |
| Sodium perborate (%) | — | — | 6.8 | 5.0 | 4.6 | — | — | — | — | 2.5 |
| Sodium chloride (%) | — | 2.1 | — | — | — | — | 0.4 | — | 0.3 | 2.5 |
| Water (%) | 8.5 | 25.0 | 5.8 | 3.8 | 2.5 | 4.2 | 12.5 | 13.2 | 16.4 | 4.1 |

| | K | L | M | N | O | P | Q | R | S | T |
|---|---|---|---|---|---|---|---|---|---|---|
| LAS (%) | 16.5 | 2.1 | — | 20.3 | 10.3 | — | 17.9 | 21.9 | — | — |
| Nonionic detergent (%) | — | 7.5 | 11.0 | 2.0 | 5.7 | 7.5 | — | 9.1 | 14.6 | 9.3 |
| Sodium carbonate (%) | 30.4 | 56.6 | 68.5 | 41.6 | — | 41.2 | 28.7 | 4.9 | — | 55.2 |
| Sodium sulfate (%) | 26.7 | — | 0.5 | 15.0 | — | — | 29.4 | 0.5 | — | — |
| Sodium silicate (%) | 12.6 | 17.3 | 8.5 | 13.0 | 2.2 | 7.1 | 14.1 | — | — | 15.6 |
| NTA (%) | — | — | — | — | 10.2 | — | — | — | — | — |
| Sodium carboxymethyl cellulose (%) | 2.1 | 1.3 | 2.5 | 0.9 | — | 1.3 | 2.0 | — | — | 2.5 |
| Borax | 1.5 | — | — | 1.9 | — | 1.9 | 2.5 | — | — | — |
| Sodium Perborate | 1.1 | — | — | 0.1 | — | 11.7 | 1.4 | — | — | — |
| Sodium Chloride | 0.9 | 0.5 | — | — | — | 25.5 | 0.2 | 0.1 | 0.3 | 9.9 |
| Water | 7.9 | 13.8 | 8.8 | 5.3 | 60.4 | 3.8 | 3.0 | 63.2 | 81.2 | 6.4 |
| | | | | | 11.9% of sodium xylene sulfonate | | | | 2.9% soap plus 1.0% of a monoethanolamide | |

Compositions containing relatively large amounts of sodium silicate are also known in the art. See, for instance the discussions in the articles by Merrill and Getty "Alkyl Aryl Sulfonate-Builder Mixtures", Ind. and Eng. Chem. 42 856ff (May 1950) and Schleyer "Silicates in Detergents", Soap and Chemical specialties November and December 1959. See also the U.S. patent to Wixon U.S. Pat. No. 3,272,753 and the article by Katstra "Formulating Detergents With Less Phosphate" in Soap and Chemical Specialties February, 1971.

The novel compositions of this invention do not give high levels of pH and are effective in hard water without yielding significant residue or scum. In fact, tests with a calcium ion electrode and turbidity measurements indicate that the compositions of this invention, unlike conventional phosphate-containing compositions do not combine with substantial quantities of calcium ions.

In accordance with one aspect of this invention it is found that this outstanding performance can be attained with compositions substantially free of carbonate and containing olefin sulfonate detergent, sodium silicate, nonionic detergent and sodium carboxymethyl cellulose, the weight ratio of olefin sulfonate to sodium silicate being in the range of about 2:1 to 1:2, more preferably about 5:3 to 3:4, the weight ratio of olefin sulfonate to nonionic detergent being in the range of about 15:1 to 6:1 or even 4:1, the weight ratio of olefin sulfonate to sodium carboxymethyl cellulose being in the range of about 90:1 to 8:1 or even 6:1. The amount of the nonionic detergent is at least about 4% of the total weight of sodium silicate plus olefin sulfonate, e.g. in the range of about 4 to 10% of that total weight. The composition preferably contains no sodium carbonate at all, but it will be understood that it is within the broad scope of the invention to add, if desired, minor amounts thereof which do not have a substantial effect on the properties, e.g. 5% of sodium carbonate based on the weight of olefin sulfonate. Also, a less preferred aspect of this invention relates to compositions which are more alkaline and contain significant proportions of sodium carbonate.

Olefin sulfonate detergents are well known in the art. Generally they contain long chain alkenyl sulfonates or long chain hydroxyalkane sulfonates (with the OH being on a carbon atom which is not directly attached to the carbon atom bearing the $-SO_3-$ group). More usually, the olefin sulfonate detergent comprises a mixture of these two types of compounds in varying amounts, often together with long chain disulfonates or sulfate-sulfonates. Such olefin sulfonates are described in many patents, such as U.S. Pat. Nos. 2,061,618; 3,409,637; 3,332,880; 3,420,875; 3,428,654; 3,506,580, and British Pat. No. 1,139,158, and in the article by Baumann et al. in Fette-Seifen-Anstrichmittel 72 no. 4 p. 247–253 (1970). All the above-mentioned disclosures are incorporated herein by reference. As indicated in these patents and published literature, the olefin sulfonates may be made from straight chain $\alpha$-olefins, internal olefins, olefins in which the unsaturation is in a vinylidene side chain (e.g. dimers of alpha olefins), etc. or, more usually, mixtures of such compounds, with the $\alpha$-olefin usually being the major constituent. The sulfonation is usually carried out with sulfur trioxide under low, partial pressure, e.g. $SO_3$ highly diluted with inert gas such as air or nitrogen or $SO_3$ under vacuum. This reaction generally yields an alkenyl sulfonic acid, often together with a sultone; the resulting acidic material is generally then made alkaline and treated to open the sultone ring to form hydroxyalkane sulfonate and alkenyl sulfonate. The number of carbon atoms in the olefin is usually within the range of 10 to 25, more commonly 12 to 20, e.g. a mixture of principally C12, C14 and C16 having an average of about 14 carbon atoms or a mixture of principally C14, C16 and C18 having an average of about 16 carbon atoms. The preferred olefin sulfonates are sodium salts but it is within the broader scope of the invention to use other water-soluble salts such as ammonium or potassium salts. Part of the olefin sulfonate detergent may be replaced by an equal weight of alkylbenzenesulfonate detergent. Thus one may replace as much as three fourths of the olefin sulfonate by akylbenzenesulfonate. The alkylbenzenesulfonate preferably has a straight chain alkyl radical of average length of about 11 to 13 or 14 carbon atoms. Preferably, the alkyl benzene sulfonate has a high content of 3- (or higher) phenyl isomers and a correspondingly low content (well below 50%) of 2- (or lower) phenyl isomers; in other terminology, the benzene ring is preferably attached in large part at the 3 or higher (e.g. 4, 5, 6 or 7) position of the alkyl group and the content of isomers in which the benzene ring is attached at the 2 or 1 position is correspondingly low. One suitable type of such detergent is described in the U.S. patent to Rubinfeld U.S. Pat. No. 3,320,174.

In addition, part, or even all, of the olefin sulfonate may be replaced by another long chain aliphatic hydrocarbon sulfonate such as a paraffin sulfonate of 10 to 20 carbon atoms; these may be the primary paraffin sulfonates made by reacting long chain alpha olefins and bisulfites (e.g. sodium bisulfite) or paraffin sulfonates having the sulfonate groups distributed along the paraffin chain such as the products made by reacting a long chain paraffin with sulfur dioxide and oxygen under ultraviolet light followed by neutralization with NaOH or other suitable base (as in U.S. Pat. Nos. 2,503,280; 2,507,088; 3,260,741; 3,372,188 and German Pat. No. 735,096).

Very good results have been obtained by the use of paraffin sulfonates whose average carbon chain length (e.g. 15–16) is significantly below that which had previously been thought to be optimum in heavy duty phosphate formulations. (see the article by Black et al in Soap/Cosmetics Chemical Specialties for November 1971, p. 37ff, particularly Table V on page 42).

The sodium silicate used in this invention has an $Na_2O:SiO_2$ weight ratio of about 1:2 to 1:3. It may be supplied in powdered or granular form or in liquid aqueous solution. It may be added to the crutcher mix used in spray-drying the product or it may be post-added to the spray-dried detergent beads or part may be included in the crutcher mix and part may be post-added. Less desirably, but within the broader scope of the invention, a sodium silicate of 1:1.6 $Na_2O:SiO_2$ weight ratio may be used to supply all or part of the sodium silicate content.

The nonionic detergent used in the present invention is preferably a monoether of a polyethylene glycol and a long chain alkanol in which the alkanol has about 10 to 16 carbon atoms and the polyethylene glycol has about 5 to 15 oxyetylene units. Such monoethers of polyethylene glycol are generally made by reacting the alkanol with ethylene oxide. Preferably the proportion of ethylene oxide is in the range of about 60 to 65%. A particularly suitable product is made by reacting 11 mols of ethylene oxide and 1 mol of a mixture of $C_{14}$ and $C_{15}$ straight chain normal primary alkanols, said mixture having an average of 14–15 (e.g. about 14.5) carbon atoms, which product is sold under the name "Neodol 4511". Or one may use another otherwise identical product in which said mol ratio is 13:1 instead of 11:1 ("Neodol 4513") or a similar product such as an adduct of seven mols of ethylene oxide and one mol of a mixture of alkanols of 12 to 15 carbon atoms ("Neodol 25-7"). Another nonionic detergent is an ether of polyethylene glycol and a blend of C16–C18 alcohols, containing about 60 or 65% ethylene oxide ("Alfonic 1618-60" or "Alfonic 1618-65"). Still another nonionic detergent is a condensation product of long chain alkanol, propylene oxide and ethylene oxide known as Plurafac B26. In the practice of the present invention the presence of the nonionic detergent has been found to be essential to attain the high all-round detergency performance, similar to, and superior to, that of high performance high phosphate detergents, in the substantial absence of carbonates.

As previously indicated, another, but less preferred embodiment of this invention relates to formulations containing sodium carbonate. In such formulations the proportions of nonionic detergent may be reduced or even eliminated. In these formulations the weight ratio of olefin sulfonate to sodium silicate is in the range of about 1:4 to 1:0.7, more preferably about 1:3 to 1:1, the weight ratio of olefin sulfonate to sodium carbonate is in the range of about 1:3 to 2:0.7, more preferably about 1:2 to 2:0.7; the weight ratio of sodium silicate to sodium carbonate is in the range of about 4:1 to 1:1, more preferably about 3:1 to 1.3:1; the weight ratio of olefin sulfonate to nonionic detergent is in the range of about 40:1 to 4:1; the weight ratio of olefin sulfonate to sodium carboxymethyl cellulose is in the range of about 40:1 to 5:1. The amount of the nonionic detergent is up to about 6% of the total weight of sodium silicate plus sodium carbonate plus olefin sulfonate, e.g. in the range of about 1.2 to 6% of that total weight. The ratio of the weight of olefin sulfonate plus sodium carbonate to the weight of sodium silicate is in the range of 5:3 to 3:5 and the ratio of the weight of sodium silicate plus sodium carbonate to the weight of olefin sulfonate is in the range of 6:1 to 3.5:2. Here again part of the olefin sulfonate (up to about three-fourths thereof) may be replaced by alkylbenzenesulfonate, as previously described.

The composition preferably also contains a fluorescent brightener in small amount. Such brighteners are well known; they may be coumarin types as illustrated in U.S. Pat. Nos. 2,590,485, 2,600,375, 2,610,152, 2,647,132 2,647,133, 1,791,564, and 2,882,186; triazolyl stilbene types as illustrated in U.S. Pat. Nos. 2,668,777, 2,684,966, 2,713,057, 2,784,183, 2,784,197, 2,817,665, 2,907,760, 2,927,866 and 2,993,892; stilbene cyanuric types as illustrated in U.S. Pat. Nos. 2,473,475, 2,526,668, 2,595,030, 2,618,636, 2,658,064, 2,658,065, 2,660,578, 2,666,052, 2,694,064, and 2,840,557; acylamino stilbene types as illustrated in U.S. Pat. Nos. 2,084,413, 2,468,431, 2,521,665, 2,528,323, 2,581,057, 2,623,064, 2,674,604, and 2,676,982; or miscellaneous types such as shown in U.S. Pat. Nos. 2,911,415 and 3,031,460. The amount of brightener may be for instance in the range of about 1/20 to 1%, e.g. 1/10 to 1/2%. One suitable combination of brighteners includes (a) a naphthotriazole stilbene sulfonate brightener, sodium 2-sulfo-4 (2-naphtho-1,2-triazolyl) stilbene, (b) another stilbene brightener, bis (anilino diethanolamino triazinyl) stilbene disulfonic acid, (c) another stilbene brightener, sodium bis (arilino morpholino triazinyl) stilbene disulfonate, and (d) an oxazole brightener, having a 1-phenyl 2-benzoaxazole ethylene structure, 2-styryl naphtha [1, 2 d] oxazole, in the relative proportions, a:b:c:d, of about 1:1:3:1.2.

Other ingredients which may be included are foam-suppressing agents; for this purpose soap, or high molecular weight amide or amine foam suppressors such as N,N-dilauryl (or dicoco alcohol) amine, may be employed in small amounts, e.g. ½ to 8% of the total composition. Other foam suppressors are silicones, e.g. dimethyl siloxane polymer, which can be used in very small proportion (e.g. 0.1%) as the sole foam suppressor or in combination with other foam suppressors. Sodium sulfate is generally also present as a diluent. When the composition is a relatively concentrated one, the amount of sodium sulfate is usually well below 25% of the total composition; larger amounts of this diluent may be present in less concentrated compositions designed to be added in larger doses to the washing machine.

Optionally the composition may contain minor proportions of sodium perborate. The presence of this ingredient has been found to be particularly useful to raise the detergency value of compositions otherwise containing less than the optimum amounts of olefin sulfonate and silicate. Thus the composition may contain about 5 to 15% of sodium perborate tetrahydrate (which is equivalent to about 0.5 to 1.5% of active oxygen in the composition) and superior results are observed even when the washing is carried at room temperatures (e.g. 120° or 140°F) well below those at which sodium perborate is known to be effective for bleaching. Other peroxygen compounds which yield active oxygen in solution in a manner similar to perborate may be substituted for all or part of the perborate; such compounds are well known in the art; sodium percarbonate (e.g. $Na_2CO_3 \cdot 1.5H_2O_2$) may be used, for instance.

It is also within the broader scope of this invention to include other builder salts in the composition in minor amounts. Among such salts are trisodium nitrilotriacetate ("NTA"), disodium hydroxyethyl nitrilodiacetate ("HEIDA"), sodium citrate, sodium boroglucoheptanoate, and even phosphates such as pentasodium tripolyphosphate or tetrasodium pyrophosphate, sodium polycarboxylates, e.g. polymaleates of low molecular weight (generally below 1,000, e.g. 400, 600 or 800), or polyphosphonic acids [such as $N(CH_2PO_3H_2)_3$, "Dequest 2000"; $(H_2O_3PCH_2)_2$ $N—CH_2CH_2—N$ $(CH_2PO_3H_2)_2$; $CH_3(CH_2)_{11}$ N $(CH_2PO_3H_2)_2$. "Dequest 2011"; $CH_3CH$ $(PO_3H)_2$; $CH_2(OH)$ $PO_3H_2$] or their sodium salts (e.g. "Dequest 2006"). Such added builder salts may be present in amounts below about 20% and preferably below 15% (e.g. about 5, 10 or 12%) of the total weight of sodium silicate plus olefin sulfonates and less than half the weight of the sodium silicate.

The following Examples are given to illustrate this invention further. In the application all proportions are by weight unless otherwise specified.

EXAMPLE 1 a. One suitable composition contains 40% olefin sulfonate; 40% sodium silicate ($Na_2O:SiO_2$ weight ratio 1:2.35); 4% "Neodol 45-11"; 2% sodium carboxymethylcellulose (water soluble, of conventional detergent grade); the balance being sodium sulfate and about 5% of water.

This formulation may be used in the form of spray dried beads. Thus, all the ingredients may be thoroughly agitated together in a conventional crutcher, the olefin sulfonate being added as an aqueous dispersion containing about 40–45% active ingredient (the balance being water, with some sodium sulfate and small amounts of conventional impurities obtained on sulfonation); and the sodium silicate being added as an aqueous liquid containing 56.5% water. The mixture may be fed from the crutcher to spray nozzles situated atop a spray tower supplied with hot air for drying and the resulting hollow beads may be collected at the base of the tower.

b. Example 1a is repeated except that the sodium carboxymethylcellulose is omitted from the crutcher mix and is, instead, added in granular form to the spray dried beads. When this mixture is dissolved in deionized water, in 0.15% concentration the solution shows a pH of 9.9.

c. Examples 1b is repeated except that the formulation includes 2% "Armeen 2C" (di coco amine) to decrease the tendency of the material to foam in an automatic washing machine.

d. Example 1b is repeated except that the formulation includes 5% soap (a sodium soap of 80% tallow fatty acids and 20% coconut oil fatty acids) to decrease the tendency of the material to foam in an automatic washing machine.

EXAMPLE 2

Example 1 is repeated except that the proportion of olefin sulfonate is 25% and the proportion of sodium silicate is 25%.

EXAMPLE 3

Example 1 is repeated except that the proportion of olefin sulfonate is 32% and the proportion of sodium silicate is 26%.

EXAMPLE 4

Example 1 is repeated except that the proportion of olefin sulfonate is 25%, the proportion of sodium silicate is 30% and granular sodium perborate tetrahydrate is also post-added to the spray-dried beads, in amount such as to provide about 15% of $NaBO_3 \cdot 4H_2O$ in the final product.

EXAMPLE 5

Example 4 is required except that the proportion of olefin sulfonate is 30% and the proportion of sodium silicate is 40%.

EXAMPLE 6

Example 1 is repeated except that the proportions are as follows: 22% olefin sulfonate, 40% sodium silicate, 15% sodium carbonate, 4% Neodol 45-11, 2.5% sodium carboxymethylcellulose about 5% water and the balance sodium sulfate.

EXAMPLE 7

Example 6 is repeated except that the proportion of Neodol 45-11 is reduced to 2%.

EXAMPLE 8

Example 1 is repeated except that the proportions are as follows: 17% olefin sulfonate, 32% sodium silicate, 23% sodium carbonate, 10% sodium perborate tetrahydrate, 4% Neodol 45-11, 2.5% sodium carboxymethylcellulose, about 5% water and the balance sodium sulfate.

EXAMPLE 9

Example 8 is repeated except that the Neodol 45-11 is omitted.

EXAMPLE 10

Example 8 is repeated except that the proportion of olefin sulfonate is 18%, the proportion of sodium silicate is 25% and the proportion of sodium carbonate is 20%.

EXAMPLE 11

To the composition of Example 1b there is added an amount of sodium carbonate equal to the amount of sodium silicate plus an amount of sodium perborate tetrahydrate equal to one half the amount of sodium silicate.

When this mixture is dissolved in deionized water, at a concentration of 0.15%, the pH of the solution is 9.9.

EXAMPLE 12

Each of the foregoing Examples is repeated except that in mixing the formulaton six tenths of the total sodium silicate may be supplied to the crutcher in the aqueous form described in Example 1, and four tenths of the total sodium silicate may be post-added, to the spray dried beads, in the form of granules of sodium silicate having a $Na_2O:SiO_2$ weight ratio of 1:2 and a water content of 18.5%.

EXAMPLE 13

Examples 1–11 are repeated using a sodium silicate in which the $Na_2O:SiO_2$ weight ratio is 1:2.0.

EXAMPLE 14

Each of the foregoing Examples is repeated except that the composition contains 1% of fluorescent brighteners.

EXAMPLE 15

Each of the foregoing Examples is repeated except that:

a. half of the olefin sulfonate is replaced by sodium linear alkylbenzenesulfonate ("LAS") having an average of 11.5 carbon atoms in its alkyl chain;

b. three fourths of the olefin sulfonate is replaced by sodium linear alkylbenzenesulfonate having an average of 11.5 carbon atoms in its alkyl chain.

EXAMPLE 16

Example 15(a) and (b) is repeated using as the linear alkylbenzenesulfonate one have an average of 13 carbon atoms in its alkyl chain.

The olefin sulfonate used in the foregoing Examples is made from an olefin mixture containing 78% alpha-olefins, 7-8% internal olefins, 14–15% olefins having pendent $=CH_2$ group (i.e. having a vinylidene group) and 0.1% of paraffins, which mixture contains 1.7% C12 olefins, 65% C14 olefins, 33.2% C16 olefins and 0.1% C18 olefins. The reaction is carried out in conventional manner: the olefin is sulfonated with $SO_3$ highly diluted with air, using slightly over 1 mol of $SO_3$ per mol of olefin, resulting acid mix is made alkaline with excess aqueous NaOH, thus converting alkenyl sulfonic acids, formed during sulfonation to the corresponding sodium salts, and resulting alkaline mixture is heated at elevated temperature (e.g. 340°F) at superatmospheric pressure to convert sultones, formed during the sulfonation, to the corresponding sodium hydroxyalkane sulfonates and alkenyl sulfonates. Similar results are obtained, in the foregoing Examples, with olefin sulfonates made in the same way from (a) a 1:1:1 mixture of 1-dodecene, 1-tetradecene and 1-hexadecene, or (b) 1-hexadecene or (c) a 10:40:40:10 mixture of 1-tetradecene, 1-hexadecene, 1-octadecene and 1-eicosene.

EXAMPLE 17

The compositions of Examples 1b and 11 are added in 0.15% concentration to water having a hardness of 150 ppm (expressed, in conventional manner, as ppm of calcium carbonate); this water is a mixture of distilled water, $CaCl_2$ and $MgCl_2$, the latter ingredients being present in amounts to provide 36 ppm of Ca ion and 14.6 ppm of Mg ion in the water. After thorough mixing, over a 10 minutes period, the concentration of unbound calcium (as indicated by the potential of a calcium electrode in contact with the solution) pH and the turbidity are measured. The water temperature is maintained at 50°C during the procedure. The following Table II give the results, and those for certain commercial detergents:

TABLE II

| Detergent | pH | Turbidity (%) | Potential of Ca electrode (millivolts) |
|---|---|---|---|
| Example 1b | 9.7 | 3.0 | −9.0 |
| Example 11 | 9.9 | 5.0 | −12.5 |
| Commercial high phosphate high performance household laundry composition | 9.1 | 8.0 | −58 |
| Another commercial high phosphate high performance household laundry composition | 8.9 | 15.0 | −45 |
| Item A of Table I (at 0.175% concentration) | 10.4 | 84.0 | −42 |
| Item H of Table I | 10.0 | 64.0 | −64 |
| Item B of Table I | 10.5 | 27.0 | −27 |

In the tests tabulated above, all detergents are used in 0.15% concentration unless otherwise indicated.

The turbidity is measured with a standard colorimeter (Model 401 of Photovolt Corp. of N.Y.) using incandescent light with a green filter; in this turbidity measurement (after 10 minutes) the hard water itself shows a turbidity of 0, the same hard water containing 0.045% $Na_2CO_3$ shows a turbidity of 66 and the same hard water containing 0.03% of LAS shows a turbidity of about 90.

The calcium electrode used for the measurement is a calcium activity electrode model 92-20 sold by Orion Research Inc. of Cambridge, Mass. and is described in detail in the published instruction manual (copyright 1966) for this instrument. This electrode develops an electrical potential across a thin layer of water-immiscible liquid ion exchanger. This liquid is held mechanically rigid by a thin porous inert membrane disc. The liquid ion exchanger, a calcium salt of an organophosphoric acid, exhibits a very high specificity for calcium ions. An internal filling solution of calcium chloride contacts the inside surface of the membrane disc. The calcium ion in this solution provides a stable potential between the inside of the membrane and the filling solution, while the chloride ion provides a stable potential between the AgAgCl reference electrode and the filling solution. Thus, changes in potential are due only to changes in sample calcium ion activity. The electrode responds only to the ionized or unbound calcium in the sample. The electrode does not respond to that portion of the calcium which is bound to complexing agents such as citrates, polyphosphates, and some proteins. According to the manufacturer this electrode exhibits Nernst potential behavior down to $10^{-4}$ moles/liter of calcium ion in accordance with the following equation:

$$E = E_x + \frac{RT}{2F} \mathrm{LOG}_{10} [A_{ca}++]$$

where $E$ = the electrode potential $E_x$ = approximately 90 mv. with a saturated KCl calomel reference electrode RT/2F = Nernst potential factor for a divalent sensing electrode (29.58 mv at 25°C)

$A_{ca}++$ = Activity of calcium ion

In making the measurement of calcium electrode potential given in Table II, the relative scale is first adjusted so that the potential for the hard water per se is minus 5 millivolts. For comparative purposes, it is noted that the same instrument, with the same adjustments, gives the following readings when tested on 0.045% solutions (adjusted to pH 10.0 with Na OH) of the following compounds in the same hard water (of 150 ppm hardness): trisodium salt of nitrilotriacetic acid ("NTA"), −75 millivolts; pentasodium tripolyphosphate, −55 millivolts; sodium citrate, −42 millivolts; sodium acetamidonitrilodiacetate, −36 millivolts; iminodiacetic acid, −12 millivolts; sodium oxalate, −38.4 millivolts. As a further comparison, tests on water itself similarly adjusted to pH 10.0 with NaOH (with the hardness changed by changing the total quantity of $CaCl_2$ and $MgCl_2$ but not their relative proportions) gives the following readings: 50 ppm hardness (as $CaCO_3$), −20 millivolts: 25 ppm hardness, −27.5 millivolts; 300 ppm hardness, +5 millivolts; this is to be compared to the −5 millivolts for the water of 150 ppm hardness and about −80 millivolts for water of zero hardness. In each case the measurements are made after 10 minutes stirring, as previously mentioned.

It will be seen that preferred compositions of this invention provide relatively low turbidity (e.g. well below 30% and generally below 25%, as in the range of 5 to 15%) and bind relatively little calcium (e.g. they show calcium electrode potentials of more than abot −25, such as in the range of −5 to −15).

EXAMPLE 18

Example 1d is repeated except that the proportion of sodium silicate is decreased to 33%.

EXAMPLE 19

Example 1d is repeated except for the following changes in proportions: the amounts of olefin sulfonate and sodium silicate are each lowered to 25% and the amount of soap is lowered, to 1%.

EXAMPLE 20

Example 1d is repeated except for the following changes in proportions: the amount of olefin sulfonate is lowered to 18%, the amount of sodium silicate is reduced to 25%, and the amount of soap is increased to 6%. It will be noted in this Example the ratio of total anionic detergent (olefin sulfonate plus soap) to nonionic detergent is about 6:1. The composition gives low foam in an automatic washing machine and exhibits excellent detergency on cotton fabrics.

EXAMPLE 21

Example 20 is repeated using in place of the olefin sulfonate a sodium paraffin sulfonate having the following chain length distribution (as determined by analysis): C13 5%, C14 16%, C15 30% C16 30%, C17 15%, C18 4%; this paraffin sulfonate also contains some 10% (based on total A.I.) of disulfonates.

EXAMPLE 22

In each of the foregoing Examples there is incorporated a mixture of two compatible blue dyestuffs of different shades but of substantially the same substantivity to the fabric so as to give to the washed fabric (when dried) a slightly blue tint. More particularly the dyes are such that, if used independently, they color the fabric greenish blue and reddish blue respectively. Specifically the detergent compositions have included therewith 0.001% of Geigy Direct Brlliant Sky Blue 6B (reference number 24410, C.I. Direct Blue 1) and 0.0003% Geigy Solophenyl Violet 4BL (reference number 29120, C.I. Direct violet 66).

In place of the specific pair of blue dyes described above one may employ a mixture of 0.002% Verona Alizarine Brilliant Sky Blue RW and 0.001% Verona Sirius Supra Blue BRL.

EXAMPLE 23

In each of the foregoing Examples there is incorporated a small amount (such as 0.1 to 0.4%, e.g. 0.2 or 0.3%) of a bleach-stable fluorescent brightener, such as 4,4'-bis (4-phenyl-2H-1,2,3-triazol-2-yl)-2,2'-stilbene disulfonic acid or a salt thereof (e.g. an alkali metal, particularly potassium, salt).

EXAMPLE 24

Instead of the blue dyes of Example 22 there is employed ultramarine blue in amount of about 0.06%. In a particularly suitable composition there is also present 10% of sodium perborate and about 0.3% of a bleach-stable fluorescent brightener such as that described in Example 23.

In the use of the detergent compositions of this invention the wash water may be hot (e.g. 120°F, 140°F or higher ) or cool (e.g. 100°F, 80°F, 70°F, or lower). The water may be soft or hard (e.g. having a hardness, expressed as calcium carbonate, of 50, 100, 150 or 200 ppm). The amount of the composition added to the wash water is generally such as to provide a sulfonate detergent concentration in the range of about 0.02 to 0.1% in the water. The compositions of the Examples (in which the content of sulfonate detergent is in the range of about 15 to 45%, the sodium silicate content is in the range of about 20 to 40%, the nonionic detergent content is in the range of up to about 6% and the sodium carboxymethyl cellulose content is in the range of about ½ to 3%) are especially formulated for use at a concentration in the range of about 0.1 to 0.2%, specifically about 0.15% of the entire composition in the wash water, and for use in the usual wash cycle, e.g. 5 to 20 minutes (most frequently about 10 minutes) of agitated washing, followed by suitable removal of wash water from the fabrics (as by spinning) and rinsing. The compositions of this invention give excellent high performance results with all-cotton fabrics and with fabrics containing synthetic fibers, such as fibers of low moisture absorption, e.g. nylon or polyethylene terephthalate, alone or in blends with cellulose fibers such as cotton or rayon. The washed clothes do not have an undesirable hand, and the compositions, particularly those containing substantially no alkali metal carbonate, have a high degree of safety and compatability with automatic washing machines. Furthermore, in comparative laundry bundle tests it is found, surprisingly, that as the test continues (with the clothes being subject to their third, fourth, fifth, etc. soiling and to their corresponding third, fourth, fifth, etc. launderings with the same given composition), compositions of this invention give better and better results in comparison to the conventional high performance phosphate detergent.

It is within the broader scope of the invention to include minor amounts of other ingredients in the compositions, e.g. germicidal agents, activators for peroxygen compounds; fabric softeners, enzymes, perfumes, coloring agents, antitarnishing agents, etc. Examples of germicidal agents are tetrachlorosalicylanilide and hexachlorophene; examples of enzymes are alkaline proteases (such as the subtilisin protease sold as Alcalase, for instance 0.1 to 1%, e.g. about ½% of "Alcalase P" having a proteolytic enzyme activity of 1.5 Anson units per gram, in the form of prilled, fine beads of a mixture of nonionic detergent and the enzyme, said enzyme being a subtilisin enzyme whose proteolytic activity is measured at a pH of 7.3 but which exhibits its maximum activity at a pH of about 8–9), and amylases (e.g. alphaamylase); examples of activators for peroxygen compounds, which activators form peracetic, perbenzoic or other peracid species in the wash water are the activator compounds named in U.S. Pat. No. 3,532,634 which also lists various suitable peroxygen compounds. Bleaching may also be effected by including in the composition solid materials that react with the wash water to form hypochlorite chlorine or hypobromite bromine; among these are N-bromo and N-chloro imides such as the heterocyclic imides like trichlorocyanuric acid, tribromocyanuric acid, dibromocyanuric acid, dichlorocyanuric acid, and salts thereof with water-solubilizing cations such as sodium or potassium. While the fabrics washed with the compositions of this invention generally have a desirable soft, non-boardy, feel, it may be desirable for certain purposes to include wash-cycle softeners with the compositions, e.g. 1,2-alkanediols having 15–18 carbon atoms. Another suitable additive is borax.

Other additives are grease dissolvers such as the ethylene oxide adducts of low ethylene oxide content such as adducts of long chain alkanols, e.g. the adducts of 3 or 4 mols of ethylene oxide and 1 mol of a blend of C12 to C15 alkanols (such as "Neodol 25-3" or "Neodol 25-4").

Still other additives are those which can serve as "carriers" for liquid nonionic detergent, giving improved flowability of granular detergent compositions. Among these are absorptive silicas or other finely divided mineral powders such as Cab-o-sil, satintone, granular TPP or even sodium carbonate in small amounts.

It is also within the broader scope of the invention to use other water-soluble high polymers serving as antiredeposition agents. For instance, in any of the Examples above, instead of the sodium carboymethylcellulose ("CMC") there may be used an equal weight of polyvinyl pyrollidone ("PVP") or a 50/50 CMC/PVP mixture, or an equal weight of polyvinyl alcohol ("PVA") or a 50/50 CMC/PVA mixture. Other water soluble high polymers which may be used are sodium starch glycolate, copolymers or maleic anhydride and vinyl monomers such as ethylene or methyl vinyl ether, sodium cellulose sulfate or sodium hydroxyethyl carboxymethyl cellulose, glyodin, starches, etc.

The detergents preferably used in this invention are, of course, water soluble, as is the sodium silicate.

It is understood that the foregoing detailed description is given merely by way of illustration and that variations may be made therein without department from the spirit of the invention. The "Abstract" given above is merely for the convenience of technical searchers and is not to be given any weight with respect to the scope of the invention.

I claim:

1. A granular non-phosphate, non-enzymatic detergent composition consisting essentially of an anionic sulfonate detergent selected from the group consisting of olefin sulfonate, paraffin sulfonate and mixtures of olefin sulfonate and paraffin sulfonate detergents, (b) sodium silicate, (c) nonionic detergent and (d) carboxymethyl cellulose, the ratio *a:b* being in the range of about 2:1 to 1:2, the ratio *a:c* being in the range of about 15:1 to 4:1, the ratio *a:d* being in the range of about 90:1 to 6:1 and the amount of *c* being at least about 4% of the total weight of *a+b*, said olefin sulfonate being a mixture of water soluble long chain alkenyl sulfonate and water soluble long chain hydroxyalkane sulfonate in water the hydroxy is on a carbon atom not directly attached to the carbon atom adjacent the sulfonate group, both said alkenyl and hydroxyalkane sulfonates being of 12 to 20 carbon atoms, said paraffin sulfonate being a water soluble salt of 10 to 20 carbon atoms, said sodium silicate being of an $Na_2O$:-$SiO_2$ weight ratio of about 1:2 to 1:3, said nonionic detergent being an ether of polyethylene glycol and a monohydric alkanol of about 10 to 18 carbon atoms wherein the polyethylene glycol is of about 5 to 15 oxyethylene units, and said composition, when dissolved in 0.15% concentration in water of 150 parts per million of hardness, resulting in a pH below 10, a turbidity of less than 30 and a calcium electrode potential of at most about 20 millivolts less than the potential of said hard water, when measured by means of a calcium activity electrode.

2. A detergent composition according to claim 1 in which the anionic sulfonate detergent is an olefin sulfonate detergent which is a mixture of water soluble long chain alkenyl sulfonate and water soluble long chain hydroxyalkane sulfonate in which the hydroxy is on a carbon chain not directly attached to a carbon atom adjacent the sulfonate group and both said alkenyl sulfonate and hydroxyalkane sulfonate and hydroxyalkane sulfonate contain an average of about 14 to 16 carbon atoms.

3. A detergent composition according to claim 1 wherein the anionic sulfonate detergent is a paraffin sulfonate having an average of 16 to 18 carbon atoms.

4. A detergent composition according to claim 1 contaning no more than about five parts of alkali metal carbonate per 100 parts of anionic sulfonate detergent.

5. A detergent composition according to claim 2 wherein the turbidity is in the range of 5 to 15 and the calcium electrode potential is at most about ten millivolts less than the potential of said hard water.

6. A detergent composition according to claim 5 which is free of water soluble alkali metal carbonate builder salt, wherein the anionic sulfonate detergent is sodium olefin sulfonate, the sodium silicate is of an $Na_2O$:$SiO_2$ ratio of about 1:2, the nonionic detergent is one in which the long chain alkyl of the long chain alkanol component is of 10 to 16 carbon atoms and the ethylene oxide content thereof is about 60 to 65% and the carboxymethyl cellulose is sodium carboxymethyl cellulose and wherein the weight ratios of *a:b*, *b:c* and *c:d* are about 5:3 to 3:4, 15:1 to 6:1 and 90:1 to 8:1, respectively, with the amount of c being from 4 to 10% of the total weight of the detergent composition.

* * * * *